US006705778B2

(12) United States Patent
Yoshida et al.

(10) Patent No.: US 6,705,778 B2
(45) Date of Patent: Mar. 16, 2004

(54) PHOTOGRAPHIC PROCESSING APPARATUS FOR PHOTOSENSITIVE MATERIAL

(75) Inventors: Futoshi Yoshida, Kanagawa (JP); Yoshinori Seguchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/401,704

(22) Filed: Mar. 31, 2003

(65) Prior Publication Data

US 2003/0185559 A1 Oct. 2, 2003

(30) Foreign Application Priority Data

Mar. 29, 2002 (JP) ..... 2002-095033
Feb. 21, 2003 (JP) ..... 2003-044654

(51) Int. Cl.[7] ..... G03D 13/00

(52) U.S. Cl. ..... 396/572; 396/578; 396/579; 396/622; 355/28; 34/445; 34/447; 34/561

(58) Field of Search ..... 396/572, 578, 396/517–626; 355/27–30; 34/419, 444, 445, 447, 561

(56) References Cited

U.S. PATENT DOCUMENTS 4,999,667 A * 3/1991 Fukushima ..... 396/622

* cited by examiner

*Primary Examiner*—D. Rutledge
(74) *Attorney, Agent, or Firm*—Sughrue Mion, PLLC

(57) ABSTRACT

A photographic processing apparatus includes a photographic paper processing bath train. A drier, positioned downstream from the train, heats air and dries the photographic paper. Feeding racks feed the paper in a predetermined travel path which begins on an upstream side of the train, extends therethrough, and ends at the drier. A memory is accessed to estimate expected travel time t1 for passing of the paper through the travel path. The memory is accessed to estimate expected warmup time t2 for warming up the air in the drier to a target temperature T2. A controller compares the time t1 and the time t2, initially starts heating in the drier if the time t2 is longer than the time t1, and starts actuation of the feeding racks when a time difference (t2-t1) elapses after start of the heating to synchronize drier warmup to temperature T2 with paper reaching the drier.

15 Claims, 9 Drawing Sheets

PHOTOGRAPHIC PROCESSING APPARATUS FOR PHOTOSENSITIVE MATERIAL

BACKGROUND OF THE INVENTION

1. Field of the Invention

The present invention relates to a photographic processing apparatus for photosensitive material. More particularly, the present invention relates to a photographic processing apparatus for photosensitive material in which a drier dries the photosensitive material by applying heat, and an energy saving operation is possible even in generating the heat.

2. Description Related to the Prior Art

A printer/processor is an apparatus used in a photo laboratory, and in which a printer section and a processor section are combined in a single manner. Photographic paper as photosensitive material is set in a paper magazine, cut by a cutter according to a printing size into a paper sheet. The paper sheet is subjected to exposure for printing in an exposure unit, to record an image photographically in a form of a latent image. The photographic paper after the exposure is aligned in one train or sorted into plural trains by a sorter, and is fed to a processor section. As is well-known in the art, the processor section includes feeding rollers and plural processing baths. The feeding rollers feed the photographic paper. The processing baths contain processing liquid for color development, bleach/fixing, rinsing and stabilization. The feeding rollers feed the photographic paper into the processing baths, causes the photographic paper to pass in the processing liquid for photographic processing.

The photographic paper after the development is moist with water. A squeezing unit removes water from the photographic paper being developed, before the photographic paper is fed into a drier and dried. The drier is constituted by a feeding rack for feeding the photographic paper, a fan or blower and a heater. The heater heats air, which is caused to flow and blow the photographic paper for the purpose of drying.

The heater is kept turned off when in a ready state. In response to an image output signal for printing to the photographic paper, the heater is turned on. Also, supply of the photographic paper is started. The heater raises the temperature of the drive to a predetermined drying temperature before the photographic paper reaches the drier.

However, a considerably high electric energy is required to raise the air temperature of the drier to a target temperature before the time of reach of the photographic paper to the drier after outputting of an image output signal for printing to the photographic paper. The energy to this end is generally higher than required for drying the photographic paper. Furthermore, the temperature in the drier is remarkably low when in an environment of a low temperature. If the heater is driven with electric energy equal to that in the room temperature, time for rise to the predetermined drying temperature is longer. In the prior art, the drier is kept at a constant high temperature by preheating operation, which causes wasteful use of power.

SUMMARY OF THE INVENTION

In view of the foregoing problems, an object of the present invention is to provide a photographic processing apparatus for photosensitive material in which a drier dries the photosensitive material by applying heat, and wasteful use of power can be prevented.

In order to achieve the above and other objects and advantages of this invention, a photographic processing apparatus for photosensitive material is provided, and includes a processing bath for processing the photosensitive material. A drier is positioned downstream from the processing bath, for heating air and for drying the photosensitive material by blowing the photosensitive material with the heated air. A feeding mechanism feeds the photosensitive material in a predetermined travel path which begins on an upstream side of the processing bath, extends through the processing bath, and ends at the drier. A first time estimating unit estimates expected travel time for passing of the photosensitive material through the predetermined travel path in feeding of the feeding mechanism. A second time estimating unit estimates expected warmup time for warming up the air in the drier up to a target temperature. A controller compares the expected travel time and the expected warmup time, initially starts heating in the drier if the expected warmup time is longer than the expected travel time, and starts actuation of the feeding mechanism when time of a difference between the expected travel time and the expected warmup time elapses after start of the heating in the drier, so as to synchronize warmup of the drier to the target temperature with a reach of the photosensitive material to the drier.

Furthermore, a temperature sensor measures an initial temperature of the air in the drier. The second time estimating unit estimates the expected warmup time according to the initial temperature.

The controller initially starts the actuation of the feeding mechanism if the expected warmup time is shorter than the expected travel time, and starts the heating in the drier when time of the difference between the expected travel time and the expected warmup time elapses after start of the actuation of the feeding mechanism.

The first time estimating unit includes a memory for storing information of the expected travel time at an address of information of a type of the photosensitive material.

The second time estimating unit includes a target temperature memory area for storing information of the target temperature. A time memory area stores information of the expected warmup time at an address of information of a temperature difference between the initial temperature and the target temperature.

The target temperature is constant.

The target temperature memory area stores the information of the target temperature at an address of information of a size of the photosensitive material.

The second time estimating unit includes a memory for storing information of the expected warmup time at an address of predetermined information that is at least one of a processed amount of the photosensitive material being supplied per unit time, a size of the photosensitive material, a type of the photosensitive material, outer temperature and outer humidity.

Furthermore, a mode selector designates a selected one of a first mode and a preheating mode. The controller, when the first mode is designated, operates according to the difference between the expected travel time and the expected warmup time, and when the preheating mode is designated, drives the drier for heating at a preheating temperature that is lower than the target temperature.

The controller drives the drier for heating at the target temperature in response to a start of feeding of the photosensitive material with the feeding mechanism during heating at the preheating temperature.

An upstream end of the predetermined travel path is provided with a photosensitive material magazine set thereon, the magazine contains the photosensitive material in a roll form. Furthermore, an exposure unit is disposed between the magazine and the processing bath, for exposure to record an image on the photosensitive material.

The drier includes a heater for heating the air. A fan or blower causes the air from the heater to flow.

The drier further includes a guide panel opposed to the photosensitive material, the photosensitive material being extended along the guide panel when fed. Plural nozzle holes are formed in the guide panel. An air duct defines an air path extending from the fan or blower to the guide panel, to direct the air from the fan or blower through the nozzle holes toward the photosensitive material.

The feeding mechanism includes a belt or roller for feeding the photosensitive material opposed to the guide panel.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
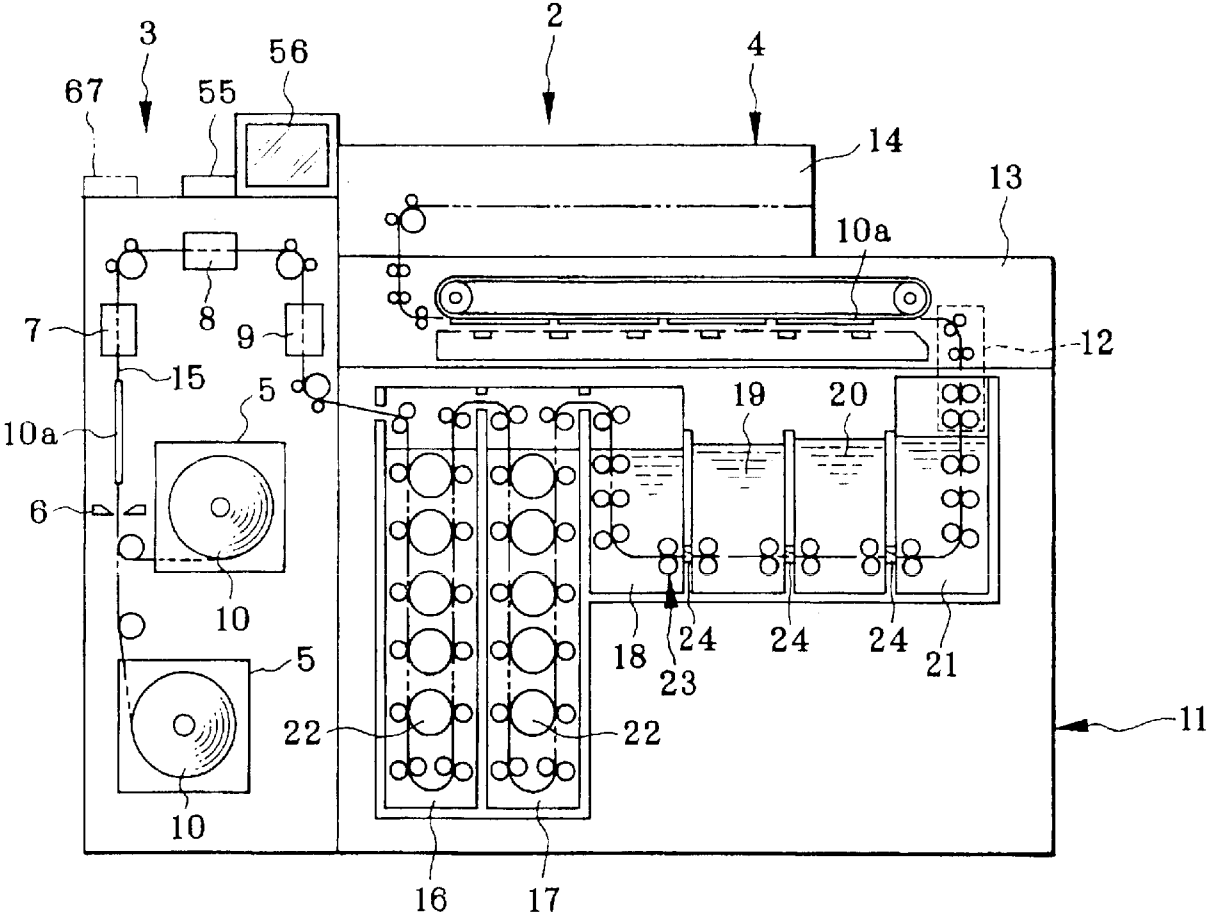
FIG. 1 is an explanatory view illustrating a printer/processor for use with photographic paper.

In FIG. 1, an inner structure of a printer/processor 2 is illustrated. The printer/processor 2 is a combined apparatus including a printer section 3 and a processor section 4. The printer section 3 is loaded with a paper supply magazine 5 as material supply position, and is constituted by a cutter 6, a back imprinting unit 7, an exposure unit 8 and a sorter 9. Long photographic paper 10 as photosensitive material is set in the paper supply magazine 5, and cut by the cutter 6 according to a printing size, to obtain a photographic paper sheet 10*a*. There is a travel path 15 indicated by the phantom line in FIG. 1, for feeding the paper sheet 10*a* toward the exposure unit 8. In the feeding, the back imprinting unit 7 imprints information to a back surface of the paper sheet 10*a*, the information including a frame number, correction data and the like. The exposure unit 8 prints an image to a print surface of the paper sheet 10*a* by exposure according to image data. The paper sheet 10*a* is aligned or sorted by the sorter 9 into trains according to the printing size, printing amount or the like, and is fed to the processor section 4.

The processor section 4 is constituted by a processing bath train 11, a squeezing unit 12, a drier 13, and a sorting unit 14. The processing bath train 11 includes a developing bath 16, a bleach/fixing bath 17, and first to fourth rinsing baths 18–21 arranged in a feeding direction of the paper sheet 10*a*. The developing bath 16 contains developing liquid. The bleach/fixing bath 17 contains bleach/fixing liquid. The rinsing baths 18–21 contain rinsing water. There are feeding racks 22, disposed in the developing bath 16 and the bleach/fixing bath 17, for feeding the paper sheet 10*a* in a U-shape. Sets of feeding rollers 23 are disposed in the rinsing baths 18–21 for feeding the paper sheet 10*a* in a U-shape. The paper sheet 10*a* is fed by the feeding racks 22 and the feeding rollers 23 into the baths 16–21, and photographically processed.

There are squeezing passageways 24 disposed between partitions of the rinsing baths 18–21 for transferring the paper sheet 10*a* from bath to bath. Each of the squeezing passageways 24 includes flexible blades of a small thickness. The blades allow passage of the paper sheet 10*a*, and at the same time block flowing out of the rinsing water. The paper sheet 10*a* being developed is passed through the squeezing unit 12 for removal of water, and sent to the drier 13. Note that it is possible instead of using the squeezing passageways 24 to feed the paper sheet 10*a* by use of feeding racks in the same manner as the developing bath 16 and the bleach/fixing bath 17.

Figure 2:
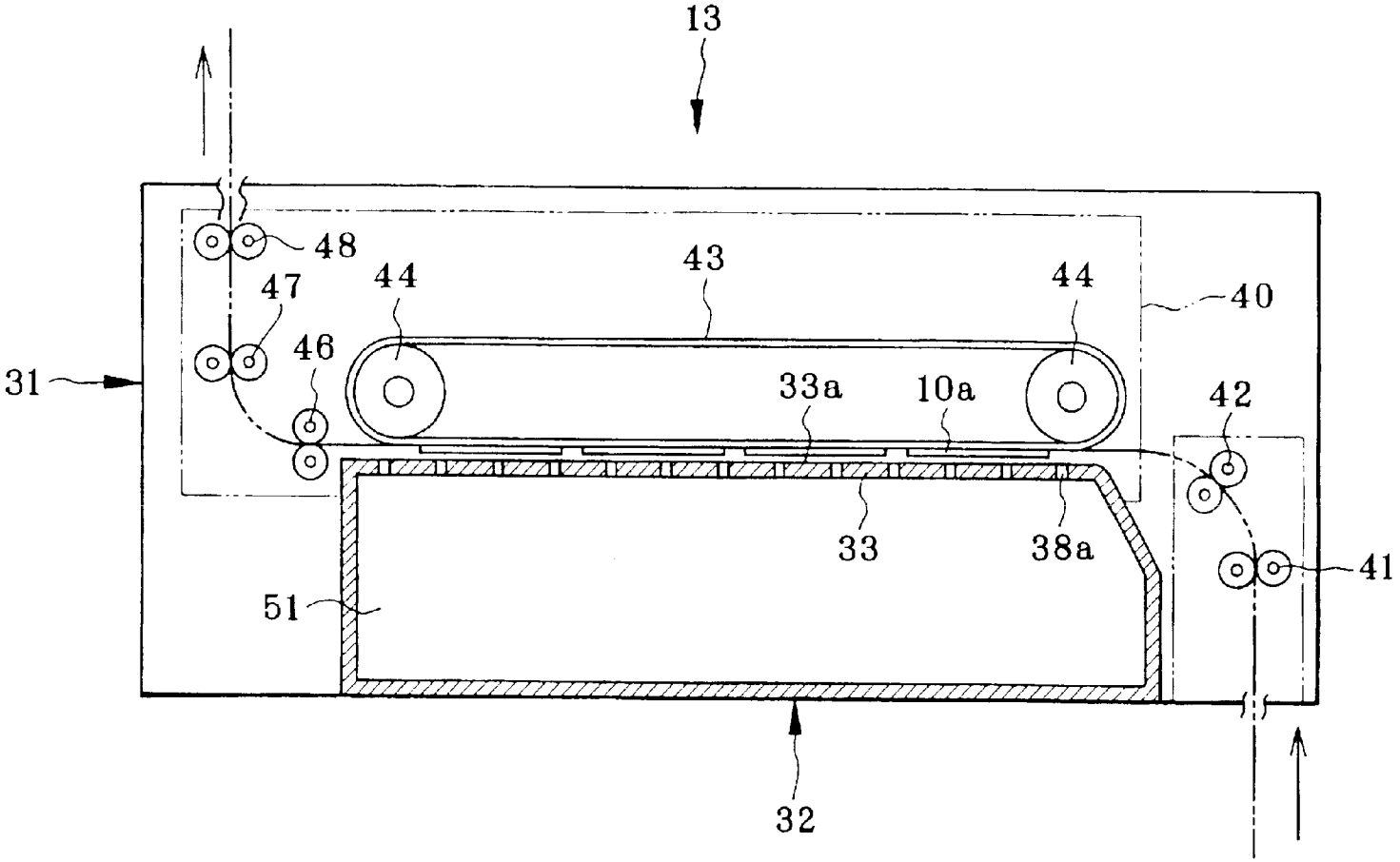
FIG. 2 is an explanatory view in vertical section illustrating a drier in the printer/processor.
Figure 3:
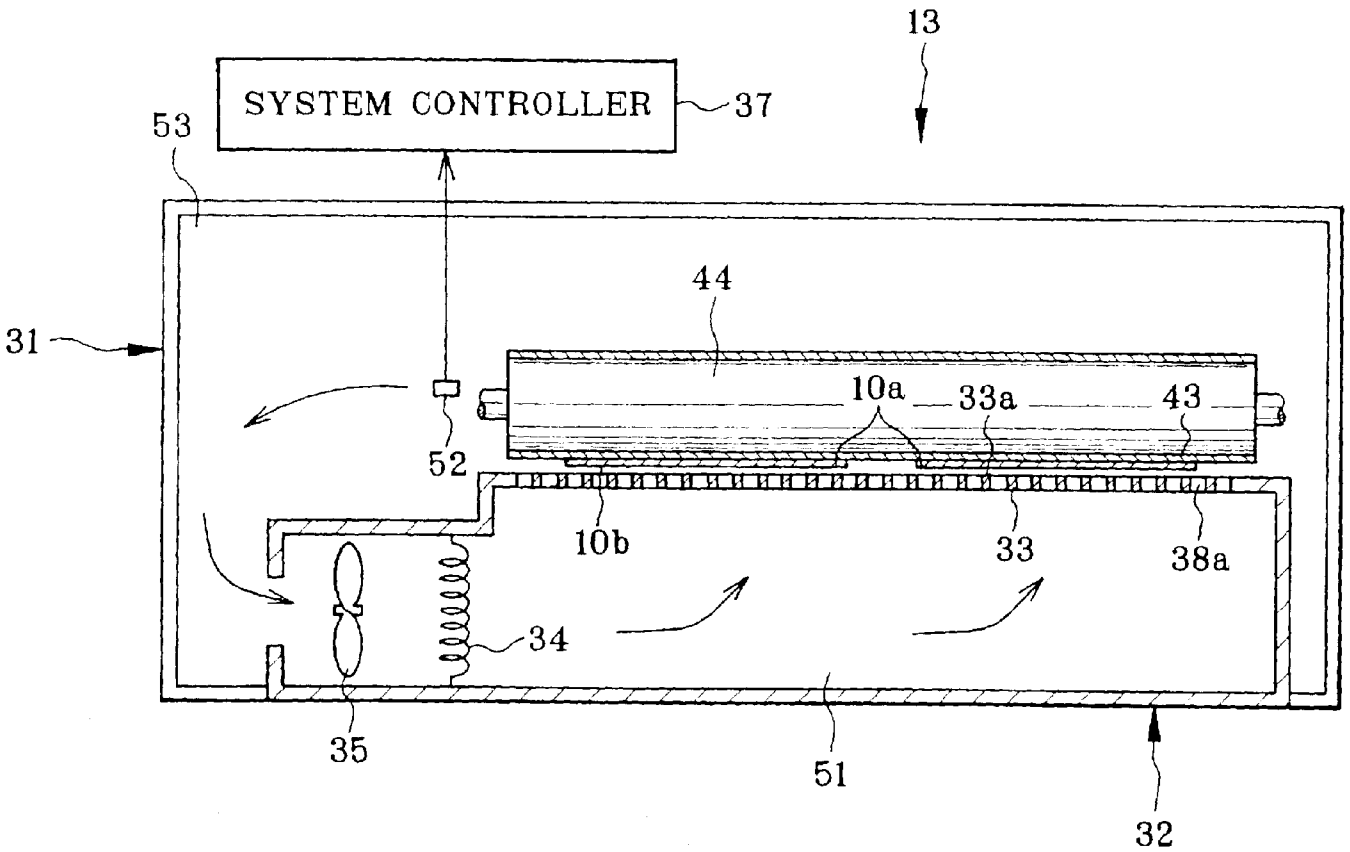
FIG. 3 is an explanatory view in cross section illustrating the drier.

In FIGS. 2 and 3, the drier 13 dries the paper sheet 10*a*, and includes elements that are a drying chamber 31, an air duct 32, a heater 34, a fan or blower 35 and a feeding rack 40.

The feeding rack 40 includes a feeding belt 43 and feeding roller sets 46, 47 and 48 which are arranged in sequence as viewed in the feeding direction of the paper sheet 10*a*, to constitute a path for the paper sheet 10*a*. Squeezing roller sets 41 and 42 in the squeezing unit 12 squeeze and feed the paper sheet 10*a* from the processing bath train 11 toward the feeding belt 43. Water on the paper sheet 10*a* is wiped away by this squeezing operation.

The feeding belt 43 is constituted by an endless belt in a mesh form. There are belt rollers 44 with the periphery of which the feeding belt 43 is engaged. The paper sheet 10*a* from the squeezing roller set 42 is blown by drying air, and pressed against the feeding belt 43 while fed. To discharge the drying air, there is a guide panel 33 through which nozzle holes 38*a* are formed. Thus, the paper sheet 10*a* is transported by the feeding belt 43 to the feeding roller set 46. A print surface 10*b* of the paper sheet 10*a* does not contact the guide panel 33, but is kept at a space from the same while the paper sheet 10*a* is fed. There is no damage of the print surface 10*b* because of no contact between the paper sheet 10*a* and the guide panel 33.

The air duct 32 has the guide panel 33 opposed to the paper sheet 10*a* and disposed to extend along the travel path. The guide panel 33 is formed from aluminum. A plate surface 33*a* of the guide panel 33 on a lateral side is colored in a black color by painting. This coloring imparts high heat conductivity to the guide panel 33, and high emissivity with reference to the paper sheet 10*a*, with total emissivity as high as 0.9 or more. An amount of radiated heat becomes higher, to dry the paper sheet 10*a* with high efficiency.

Figure 4:
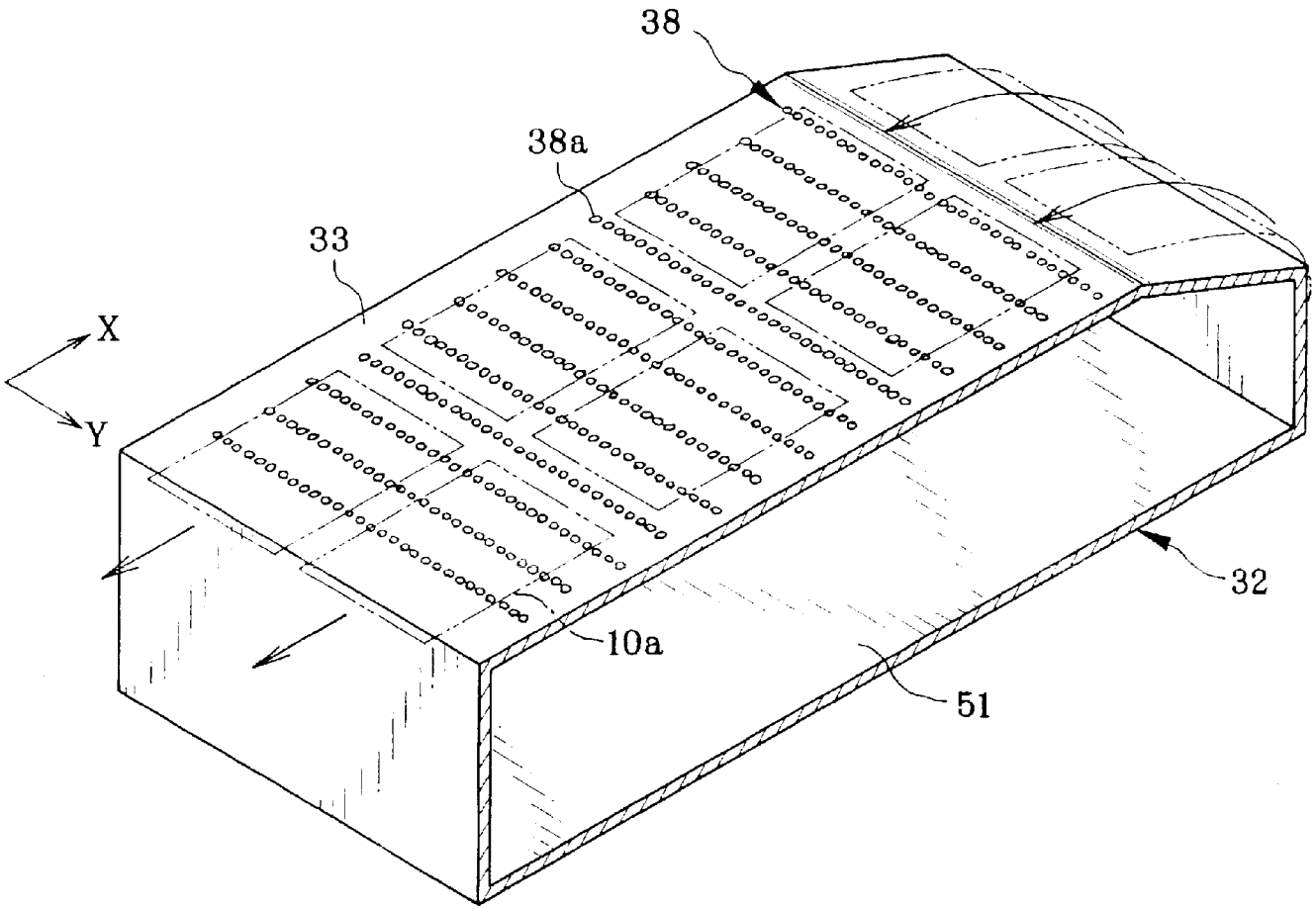
FIG. 4 is a perspective, partially cutaway, illustrating the drier.

In FIG. 4, a number of nozzle trains 38 extend in a direction Y crosswise to a feeding direction X, and are arranged in the feeding direction X. Each of the nozzle trains 38 includes a great number of the nozzle holes 38*a* arranged at a regular pitch in the crosswise direction Y. The nozzle holes 38*a* have a circular shape with a diameter D. The nozzle holes 38*a* are so positioned that one of the nozzle holes 38*a* in a first train of the nozzle trains 38 is offset from the nozzle holes 38*a* in a second train adjacent to the first train by an amount of D/4 in the crosswise direction Y. Therefore, the drying air can blow the paper sheet 10*a* without unevenness. Note that, instead of the circular shape, the nozzle holes can have any suitable shape such as an elliptical shape, a straight shape as slits, and the like.

The nozzle holes 38*a* have an aperture ratio of 50% or less with reference to the guide panel 33. The determination of the low aperture ratio of the nozzle holes 38*a* makes it possible to determine an air flow rate of drying air discharged through the nozzle holes 38*a* to blow the paper sheet 10*a*. A speed of drying of the paper sheet 10*a* depends on the air flow rate of air of blowing. The air flow rate is determined high to set the drying speed high.

In FIGS. 2 and 3, an air supply path 51 is formed in the air duct 32 for blowing drying air through the nozzle holes 38*a*. The heater 34 and the fan 35 are disposed in the air supply path 51. The fan 35 causes the drying air to flow in the drier 13 for circulation. A temperature adjusting controller 36 controls the heater 34 to heat the drying air at 80° C.

After the paper sheet 10*a* is dried by the drying air from the guide panel 33, the feeding roller sets 46–48 feed the paper sheet 10*a* toward the sorting unit 14. The paper sheet 10*a* passed through the drier 13 is sorted by the sorting unit 14 into units of requests.

Figure 5:
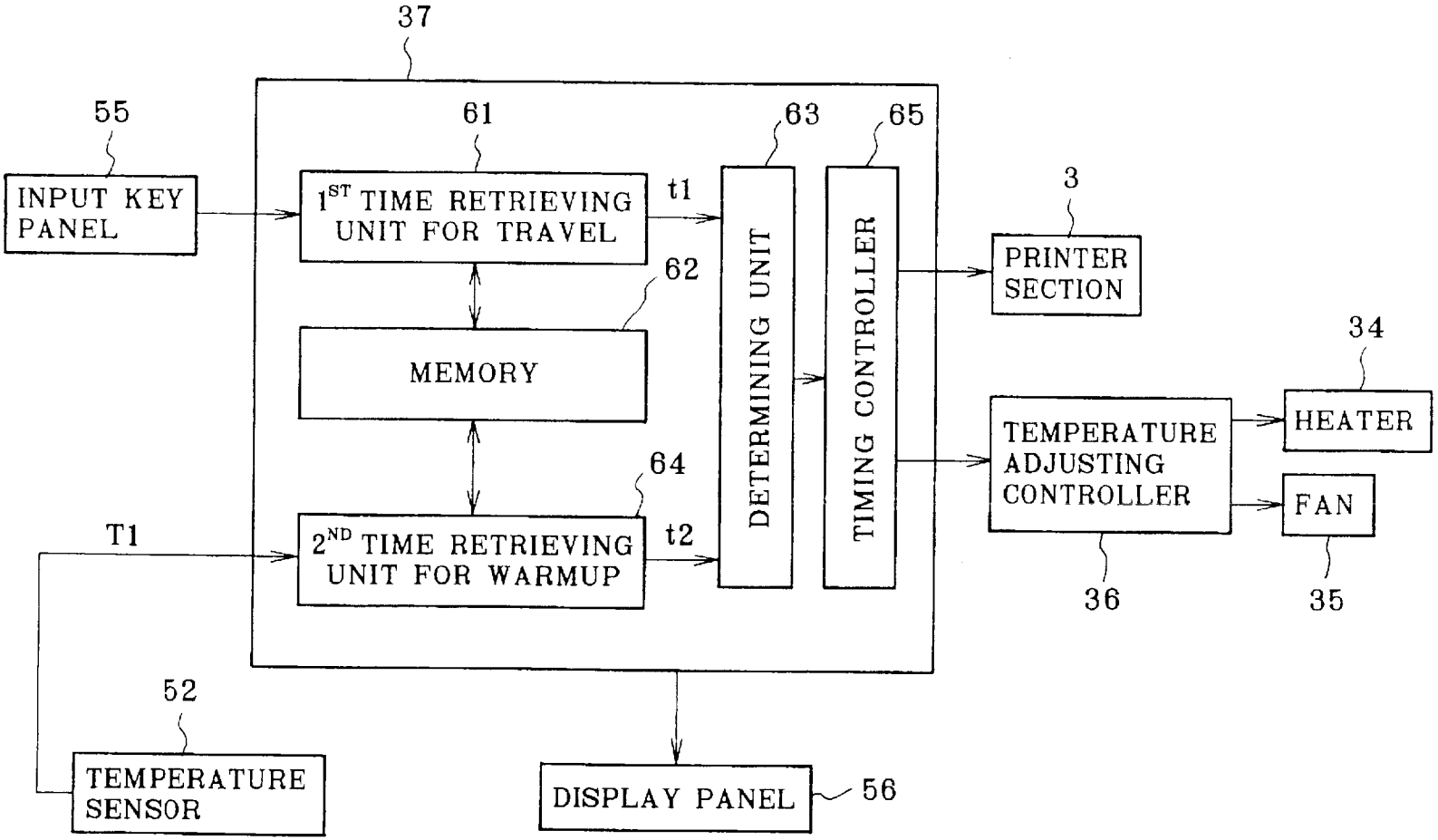
FIG. 5 is a block diagram illustrating circuit arrangement of the printer/processor with circuits for a starting control.

A system controller 37 controls the various elements of the printer/processor for printing and processing of the paper sheet 10*a*. In FIG. 5, an input key panel 55 as a mode selector and a display panel 56 are connected with the system controller 37. A user operates the input key panel 55 to input signals to set various modes, a command signal, and the like. The display panel 56 displays information of guidance, inputs of the keys for the modes and command signals, and the like. If a simulation mode for displaying a designated image for printing is selected, then the display panel 56 displays the image as simulation.

When supply of power to the printer/processor 2 is initially turned on, the system controller 37 operates for starting control, namely raises the temperature of the drier to a predetermined drying temperature according to a temperature signal from a temperature sensor 52 disposed in the drier 13. At the time of the starting control, there are two drying modes including a rapid driving mode and an energy saving driving mode, which are set according to turning on or off of a preheating mode.

When the preheating mode is turned on, the rapid drying is set at the time of starting control. In a normal state of the printer/processor, the rapid drying is determined as a default setting. It is to be noted that the default setting may be changed if desired, and that the energy saving mode may be determined as a default setting. In the state of the preheating mode, preheating is started upon turning on of the power source of the printer/processor 2 in the same manner as the widely used system. The heater 34 is controlled to set the drier 13 at the preheating temperature. The fan 35 is also driven. Note that the preheating temperature is predetermined equal to or lower than the target temperature. When the material supply signal is input in the state of setting the preheating mode, the paper sheet 10*a* starts being supplied. The air temperature is controlled and raised to a target temperature. The starting control can be rapidly effected. However, a problem remains in requirement of high electric power due to the temperature control to the preheating temperature and the target temperature.

Figure 6:
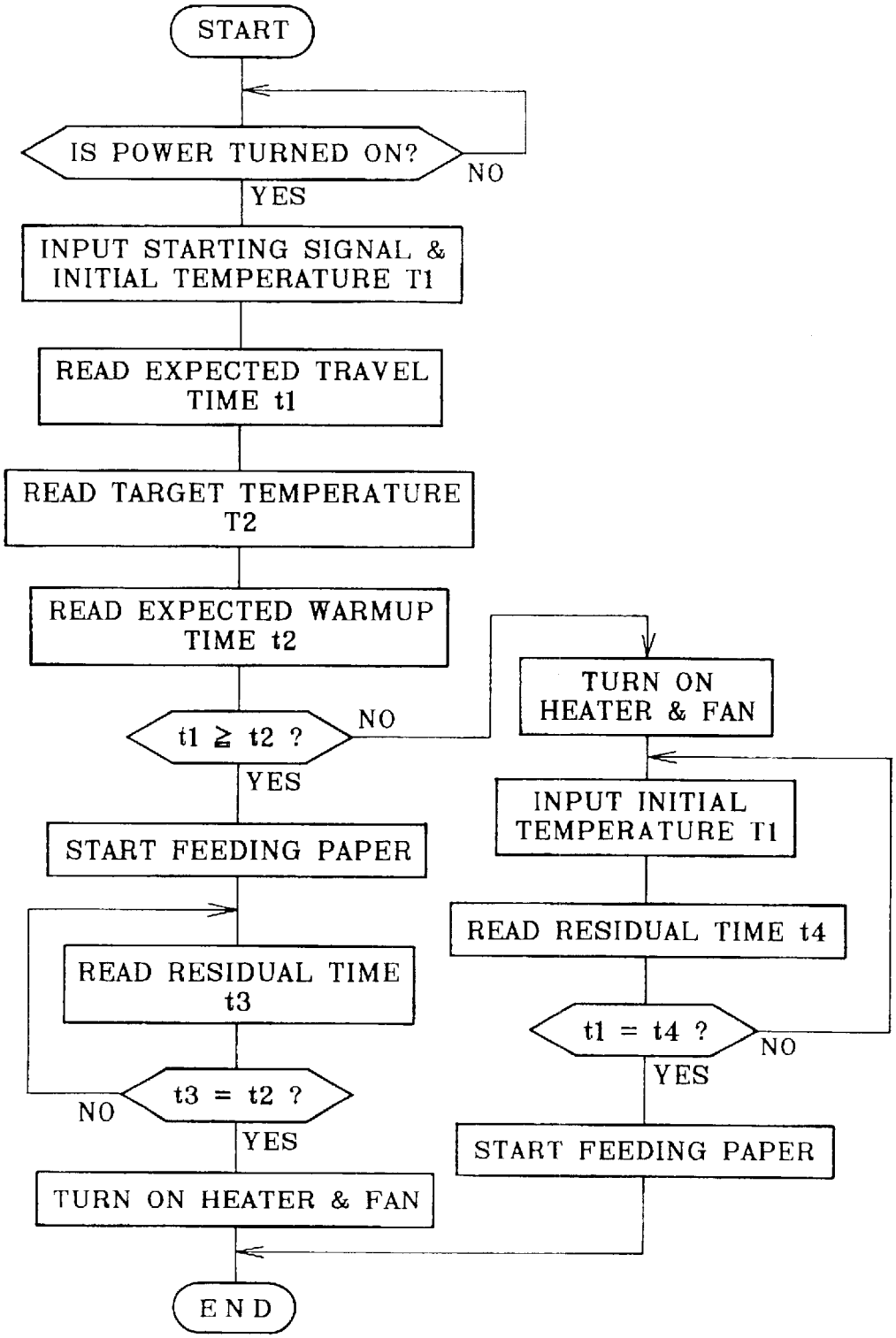
FIG. 6 is a flow chart illustrating operation of the printer/processor.

The energy saving driving is used when the preheating mode is turned off. The supply of the photographic paper and the heating of the heater are controlled in the energy saving driving according to the structure of FIG. 5 and a flow in FIG. 6. In the energy saving driving, the system controller 37 receives a printing starting signal from the input key panel 55, sends a material supply signal to a material supply section, obtains an expected travel time for reach of the photographic paper, and an expected warmup time for reach of the drying temperature. According to the time difference between the expected times, heating and a start of supply of photographic paper are controlled to obtain the target temperature.

The expected travel time t1 is determined between starting and ending points of time, the starting point being upon the inputting of a material supply signal to the system controller 37, and the ending point being upon the reach of the paper sheet 10*a* to the drier 13. In the period of the expected travel time t1, events occur in a sequence, including drawing of the photographic paper 10 from the paper supply magazine 5, cutting of the photographic paper 10 into the paper sheet 10*a* with the cutter 6, back imprinting of the paper sheet 10*a* at the back imprinting unit 7, exposing of the paper sheet 10*a* at the exposure unit 8, alignment or sorting of the paper sheet 10*a* in the sorter 9, photographic processing in the processing bath train 11, and squeezing in the squeezing unit 12 before the reach to the drier 13. A first time retrieving unit 61 as a first time estimating unit is included in the system controller 37. Upon a starting signal is input through the input key panel 55, a memory 62 in first and second time estimating units is accessed by the first time retrieving unit 61 to read the expected travel time t1. A determining unit 63 as controller is supplied with a signal of the expected travel time t1. Note that the expected travel time t1 is predetermined for the types of the photographic paper, and stored in memory areas in the memory 62. Furthermore, it is possible that the printer/processor according to the invention lacks the back imprinting unit 7 or the exposure unit 8.

The temperature sensor 52 is disposed in a circulation path 53 inside the drier 13. See FIG. 3. The temperature sensor 52 detects an initial temperature T1 of the air in the drier 13. A signal from the temperature sensor 52 is sent to the system controller 37. A second time retrieving unit 64 in the second time estimating unit refers to the initial temperature T1 from the temperature sensor 52, and reads the expected warmup time t2 from a time memory area of the memory 62 by turning on the heater 34 to obtain the target temperature T2 of the drying air as predetermined for each of the printing sizes. Then the second time retrieving unit 64 outputs information of the expected warmup time t2 to the determining unit 63. The expected warmup time t2 required for reach to the target temperature T2 optimized for each of the printing size is determined according to the initial temperature T1 measured by the temperature sensor 52 in a stepwise manner of steps of 0.2 degree. The target temperature T2 and the expected warmup time t2 are stored in a predetermined area in the memory 62. Note that it is possible to dispose the temperature sensor 52 in the air duct 32.

The determining unit 63 compares the expected travel time t1 and the expected warmup time t2 to obtain a comparison result, which is sent to a timing controller 65. If it is determined in the timing controller 65 that $t1 \geqq t2$, a material supply signal is sent to the printer section 3, to start supply of the paper sheet 10*a*. The timing controller 65 considers an elapsed time after the start of the supply of the paper sheet 10*a*, calculates the residual time t3 by subtracting the elapsed time from the expected travel time t1. When the residual time t3 comes down and becomes equal to the expected warmup time t2 (t3=t2), then the temperature adjusting controller 36 turns on the heater 34 and the fan 35 to heat the air in the drier 13. The printer section 3 operates in response to the material supply signal, draws the photographic paper 10 from the paper supply magazine 5, and actuates the cutter 6 to cut the photographic paper 10 into the paper sheet 10*a* in a size according to the printing size. The paper sheet 10*a* is subjected to various processes in the back imprinting unit 7, the exposure unit 8, the sorter 9, the processing bath train 11 and the squeezing unit 12, and is aligned or sorted to one or more trains, which reach the drier 13. At the time of reach of the paper sheet 10*a* at the drier 13, the target temperature T2 of the drier 13 has already become 80° C. So the paper sheet 10*a* can be dried efficiently. This is effective in suppressing the wasteful use of power in a standby manner, because warmup of the drier 13 to the target temperature T2 is not too early.

If t1<t2, then the timing controller 65 turns on the heater 34 and the fan 35, and raises the temperature of the air inside the drier 13. According to an output of the temperature sensor 52, the second time retrieving unit 64 obtains the residual time t4 in a stepwise manner of steps of 0.5 second. When the residual time t4 becomes equal to the expected travel time t1, then a material supply signal is sent to the printer section 3. The paper sheet 10*a* is passed through the path described above. When the paper sheet 10*a* reaches the drier 13, the drier 13 has been heated to the target temperature T2, for example 80° C. Thus, the paper sheet 10*a* can be dried efficiently. Thus, it is unnecessary to raise capacity of the heater 34 for the purpose of heating to the target temperature according to the widely used preheating method. The starting control is possible in an energy saving manner by taking sufficient process time in the printer/processor 2.

Figure 7:
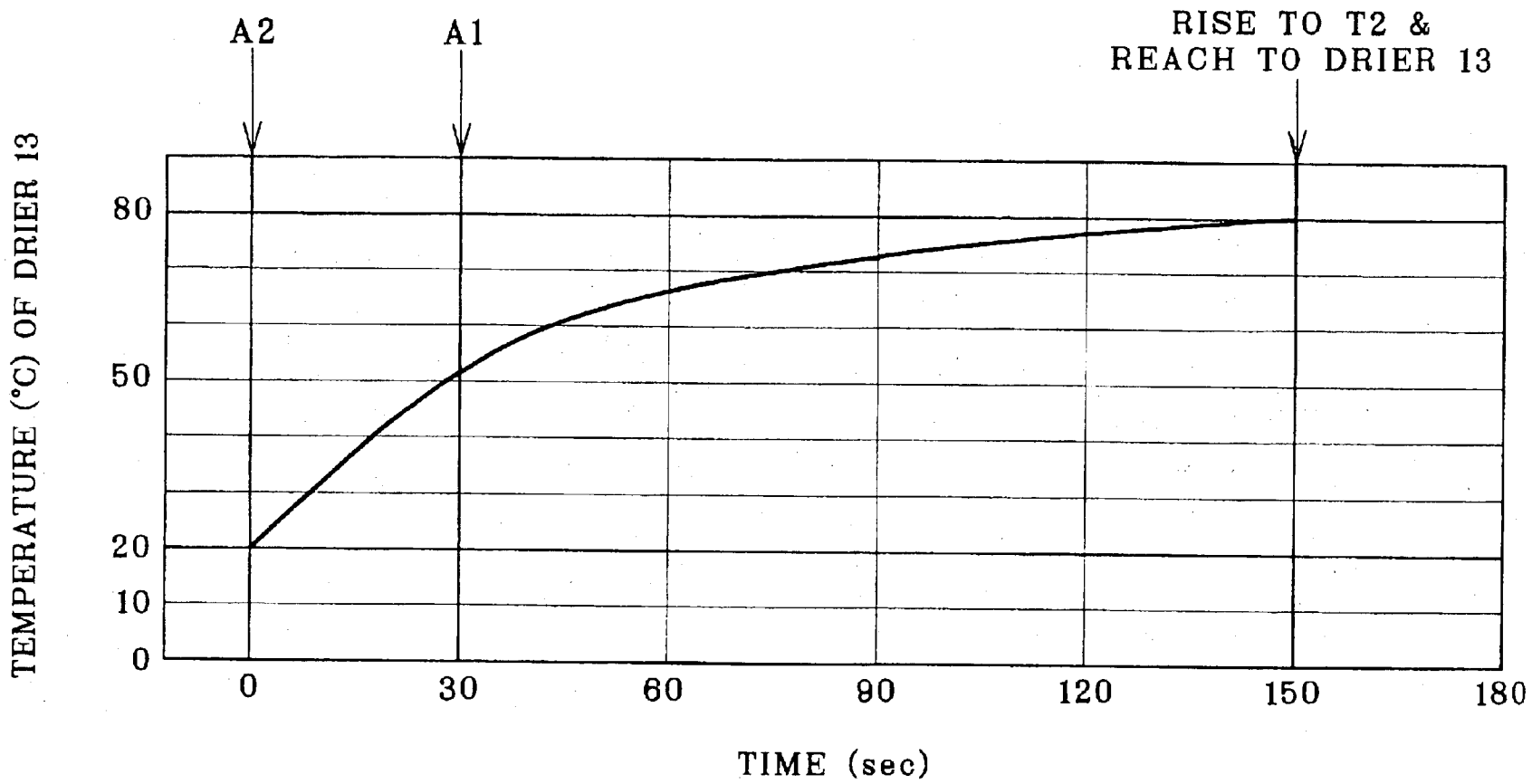
FIG. 7 is a graph illustrating a pattern of supply of the photographic paper and driving of a heater.
Figure 8:
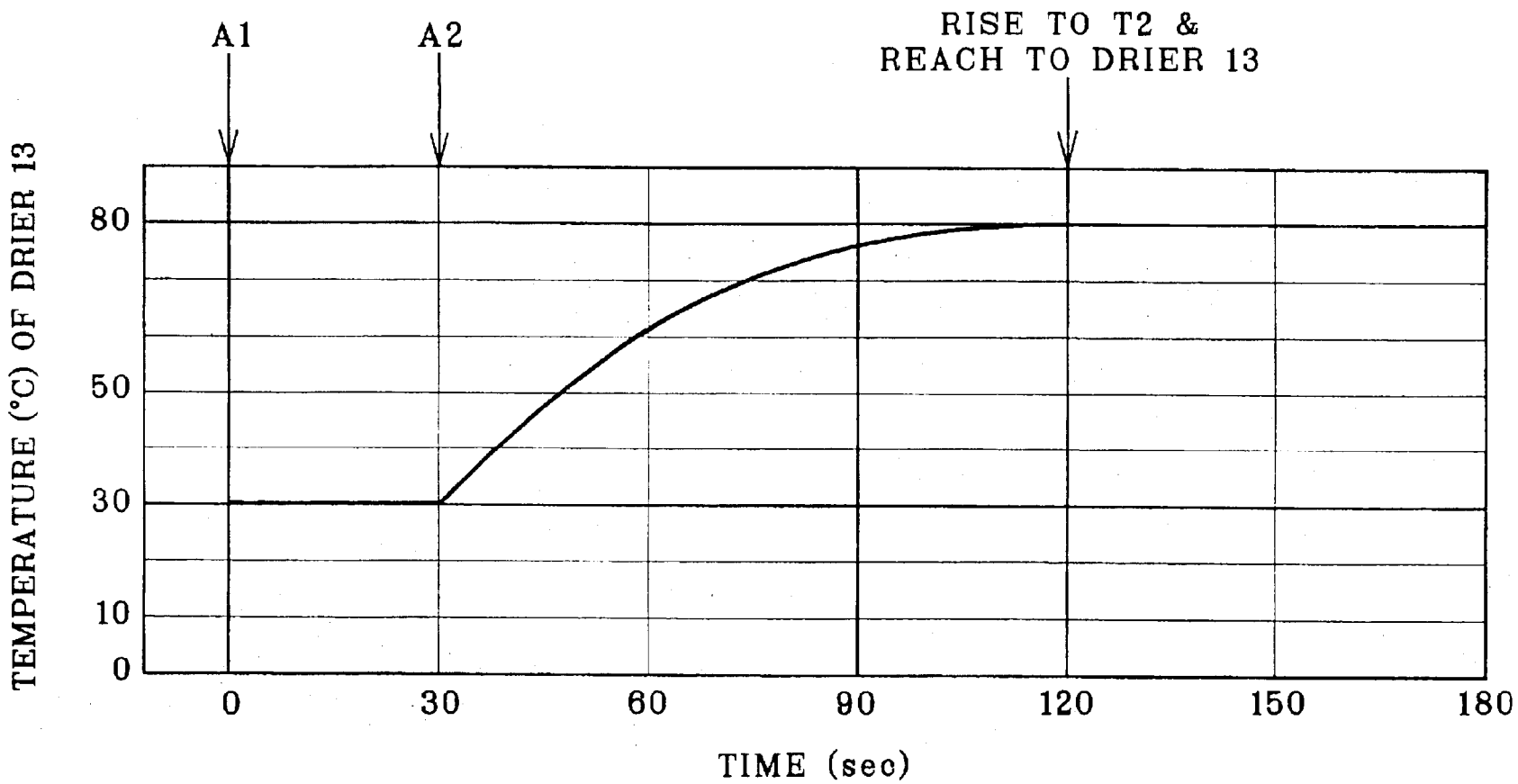
FIG. 8 is a graph illustrating a pattern similar to that of FIG. 7 but in which $t2<t1$.

In FIGS. 7 and 8, a rise of the temperature of the air in the drier 13 is illustrated with time. Also, a point of time A1 of sending signals to the printer section 3, and point of time A2 of turning on the heater 34 and the fan 35 are illustrated. The signals being sent are information of the initial temperature T1, the target temperature T2, the expected travel time t1, the expected warmup time t2, the residual time t3, and the residual time t4, and also include the material supply signal.

In FIG. 7, an example is depicted with conditions of T1 of 20° C., T2 of 80° C., t1 of 2 minutes, and t2 of 2 minutes and 30 seconds that is longer than t1 (t1<t2). The timing controller 65 initially turns on the heater 34 and the fan 35. When t1 becomes equal to t4, a material supply signal is sent to the printer section 3. When the paper sheet 10*a* reaches the drier 13 after passing the above-described path, the temperature of the drier 13 has become T2 that is 80° C. It is possible to dry the paper sheet 10*a* in an optimized environment.

In FIG. 8, an example is depicted with conditions of T1 of 30° C., T2 of 80° C., t1 of 2 minutes, and t2 of 1 minute and 30 seconds that is shorter than t1 (t1>t2). The timing controller 65 initially sends a material supply signal to the printer section 3. When 30 seconds elapses, t3 becomes equal to t2. The heater 34 and the fan 35 are turned on to raise the temperature of the air in the drier 13. When the paper sheet 10*a* reaches the drier 13, the temperature of the drier 13 has become T2 that is 80° C. It is possible to dry the paper sheet 10*a* in an optimized environment.

The drying air blowing the paper sheet 10*a* is passed through the feeding belt 43 having a mesh form, flows through the circulation path 53 and then back to the air supply path 51. The fan 35 is driven to circulate the drying air. After reaching the predetermined temperature, the drying air can be maintained at the predetermined temperature with high efficiency.

When the heater 34 is turned off, no abrupt drop in the temperature occurs in the drier 13 because of residual heat of the heater 34. So it is possible for the system controller 37 to turn off the heater 34 before drying the final one of the paper sheets 10*a* in the drier 13 according to the information of the number of paper sheets to be processed residually. For example, the heater 34 is turned off when the number of paper sheets to be processed residually becomes five (5). After this, the residual heat of the heater 34 dries the paper sheet 10*a*.

It follows that the rapid driving for the starting control can be selected typically on busy days for printing, for example holidays and Mondays directly after holidays due to numerous requests of customers for printing, because of the selective designation between the rapid driving and the energy saving driving. The energy saving driving can be selected for remaining days of the week, to save energy after taking sufficient waiting time for the starting control.

Calculation of the expected travel time t1 is effected according to the following. Sensors (not shown) are associated with respectively the cutter 6, the back imprinting unit 7, the exposure unit 8, the sorter 9 and the squeezing unit 12 for detecting existence of the paper sheet 10*a*. After a material supply signal is sent to the printer section 3 per each one of the photographic paper type, periods of time are measured and obtained between the material supply signal and each of detections of the paper sheet 10*a* at the sensors in the cutter 6, the back imprinting unit 7, the exposure unit 8, the sorter 9 and the squeezing unit 12. The expected travel time t1 is obtained according to those periods of time and process times in those elements, in a provisional manner before the printing/processing operation. It is to be noted that any suitable method may be used to calculate the expected travel time t1. Also, the expected travel time t1 may be obtained by calculation of a predetermined travel path length and feeding speed changeable according to the photographic paper types.

In the above embodiment, the expected travel time t1 and the expected warmup time t2 are predetermined for the printing sizes or the like, and stored in the memory. Alternatively, it is possible to store information of calculation equations, and to obtain the expected travel time t1 and the expected warmup time t2 by calculation according to the equations.

In the above embodiment, the target temperature T2 is fixed at 80° C. However, the target temperature T2 may be changeable and determined in an optimized manner according to the printing size, the photographic paper type of each of sheet trains. Furthermore, a temperature sensor may be incorporated in the printer/processor for measuring environmental temperature. It is possible to compensate for the target temperature T2, the expected travel time t1 or the expected warmup time t2 according to the environmental temperature. Also, a humidity sensor may be added to the temperature sensor. The target temperature T2, the expected travel time t1 or the expected warmup time t2 may be compensated for according to an output of the humidity sensor. It is possible to dispose a temperature sensor or humidity sensor in a squeezing unit, and to compensate for the target temperature T2, the expected travel time t1 or the expected warmup time t2 according to an output from the sensor in the squeezing unit.

Figure 9:
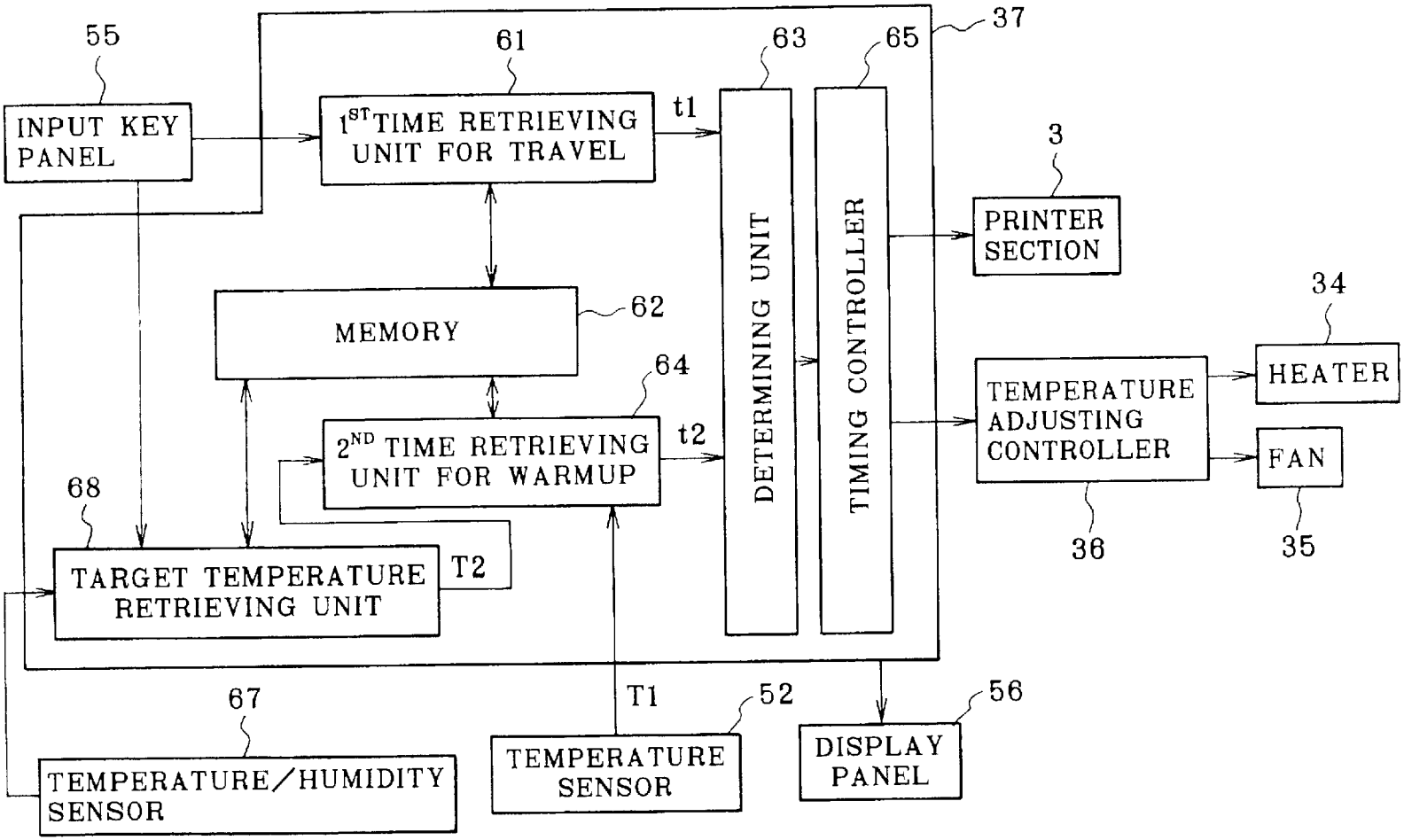
FIG. 9 is a block diagram illustrating another preferred circuit arrangement which includes a target temperature retrieving unit.

In FIG. 9, another preferred embodiment is illustrated, in which the optimized target temperature T2 is obtained in consideration of at least one of a type of emulsion of the photographic paper, a width of the photographic paper, outer temperature and humidity of the outside of the printer/processor, manually input compensation values of a user, and the like.

The paper emulsion types and the paper width are distinguished by the magazine ID number of the paper supply magazine 5. In a user s loading of the paper supply magazine 5 with the photographic paper 10, relationships between the photographic paper 10 and the magazine ID number are recorded. When the input key panel 55 is operated, the information is written to a predetermined memory area in the memory 62 of the system controller 37, the information including the magazine ID number, the paper emulsion types and the paper width. When the paper supply magazine 5 is set in the printer section 3, the magazine ID number is input by operating the input key panel 55. According to the information of the magazine ID number being input, information of the paper emulsion types and the paper width is obtained. Note that, instead of using keys to input the magazine ID number, a bar code form of magazine ID number may be recorded on the paper supply magazine 5. It is possible to input the magazine ID number by automatically reading same at a bar code reader associated with the printer section 3. Also, an IC tag may be associated with the paper supply magazine 5, and store information of the paper emulsion types, the paper width, and the magazine ID number, which can be read for inputting the information.

A temperature/humidity sensor 67 is disposed on an outer panel of the printer/processor 2, indicated by the phantom line in FIG. 1, and operates to detect the temperature and humidity of the outer atmosphere. A signal from the temperature/humidity sensor 67 is sent to the system controller 37. Note that the manually input compensation values of a user are input by operating the input key panel 55, and are parameters with which he or she can adjust the extent of the drying operation, for example five step values between strong drying and weak drying.

The optimized target temperature T2 is predetermined according to data including the paper emulsion type, the paper width, the temperature and humidity of the printer/processor, manual compensation values and the like. Table data including data of those items are stored in a predetermined memory area in the memory 62. A target temperature retrieving unit 68 in the second time estimating unit receives data, refers to and obtains the target temperature T2 according to the received data, and sends the target temperature T2 to the second time retrieving unit 64. The second time retrieving unit 64 obtains a temperature difference by subtraction between the target temperature T2 and the initial temperature T1 measured by the temperature sensor 52. According to the temperature difference, the predetermined memory area in the memory 62 is referred to, to read and obtain the expected warmup time t2. Relationships between the temperature difference and the expected warmup time t2 are previously obtained, and written in a predetermined memory area in the memory 62. It is to be noted that, instead of reading from the memory 62, equations to calculate the expected warmup time t2 according to a temperature difference may be previously determined experimentally. The expected warmup time t2 can be obtained according to the calculation equations.

In the above embodiment, the initial temperature T1 detected by the temperature sensor 52 is referred to, to determine the target temperature T2 by the target temperature retrieving unit 68 and the memory 62. The target temperature T2 is then referred to, to determine the expected warmup time t2 by the second time retrieving unit 64 and the memory 62. However, it is possible to determine the expected warmup time t2 by considering the initial temperature T1 detected by the temperature sensor 52 by use of a certain retrieving operation without obtaining the target temperature T2 in an intermediate manner. To this end, it is possible to use a table memory, a program of calculation, or the like.

In the above embodiments, the heating according to the invention is used for starting the heater 34 in the drier 13. However, the feature of the invention may be used for starting operation of applying heat to the liquid in the baths 16–21 to a certain target temperature.

In the above embodiments, the feature of the invention is used in the printer/processor. However, a combination of a printer and a processor separate therefrom may be provided with the feature of the above embodiments. To produce prints, the processor is connected with the printer. Also, a processor as a single device may be provided with the feature of the invention. A photographic paper magazine with the photographic paper is set in the processor, to supply the photographic paper, which is aligned or sorted in plural trains. The photographic paper is developed and subjected to determination of time for reach to the drier 13. As has been described above, the time difference is considered for the purpose of control.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A photographic processing apparatus for photosensitive material, comprising:

a processing bath for processing said photosensitive material;

a drier, positioned downstream from said processing bath, for heating air and for drying said photosensitive material by blowing said photosensitive material with said heated air;

a feeding mechanism for feeding said photosensitive material in a predetermined travel path which begins on an upstream side of said processing bath, extends through said processing bath, and ends at said drier;

a first time estimating unit for estimating expected travel time for passing of said photosensitive material through said predetermined travel path in feeding of said feeding mechanism;

a second time estimating unit for estimating expected warmup time for warming up said air in said drier up to a target temperature;

a controller for comparing said expected travel time and said expected warmup time, for initially starting heating in said drier if said expected warmup time is longer than said expected travel time, and for starting actuation of said feeding mechanism when elapsed time after start of said heating in said drier becomes equal to a difference between said expected travel time and said expected warmup time, so as to synchronize warmup of said drier to said target temperature with a reach of said photosensitive material to said drier.

2. A photographic processing apparatus as defined in claim 1, further comprising a temperature sensor for measuring an initial temperature of said air in said drier;

said second time estimating unit estimates said expected warmup time according to said initial temperature.

3. A photographic processing apparatus as defined in claim 2, wherein said controller initially starts said actuation of said feeding mechanism if said expected warmup time is shorter than said expected travel time, and starts said heating in said drier when elapsed time after start of said actuation of said feeding mechanism becomes equal to said difference between said expected travel time and said expected warmup time.

4. A photographic processing apparatus as defined in claim 3, wherein said first time estimating unit includes a memory for storing information of said expected travel time at an address of information of a type of said photosensitive material.

5. A photographic processing apparatus as defined in claim 4, wherein said second time estimating unit includes:

a target temperature memory area for storing information of said target temperature; and a time memory area for storing information of said expected warmup time at an address of information of a temperature difference between said initial temperature and said target temperature.

6. A photographic processing apparatus as defined in claim 5, wherein said target temperature is constant.

7. A photographic processing apparatus as defined in claim 5, wherein said target temperature memory area stores said information of said target temperature at an address of information of a size of said photosensitive material.

8. A photographic processing apparatus as defined in claim 3, wherein said second time estimating unit includes a memory for storing information of said expected warmup time at an address of predetermined information that is at least one of a processed amount of said photosensitive material being supplied per unit time, a size of said photosensitive material, a type of said photosensitive material, outer temperature and outer humidity.

9. A photographic processing apparatus as defined in claim 1, further comprising a mode selector for designating a selected one of a first mode and a preheating mode;

said controller, when said first mode is designated, operates according to said difference between said expected travel time and said expected warmup time, and when said preheating mode is designated, drives said drier for heating at a preheating temperature that is lower than said target temperature.

10. A photographic processing apparatus as defined in claim 9, wherein said controller drives said drier for heating at said target temperature in response to a start of feeding of said photosensitive material with said feeding mechanism during heating at said preheating temperature.

11. A photographic processing apparatus as defined in claim 1, wherein an upstream end of said predetermined travel path is provided with a photosensitive material magazine set thereon, said magazine contains said photosensitive material in a roll form;

further comprising an exposure unit, disposed between said magazine and said processing bath, for exposure to record an image on said photosensitive material.

12. A photographic processing apparatus as defined in claim 1, wherein said drier includes:

a heater for heating said air; and a fan or blower for causing said air from said heater to flow.

13. A photographic processing apparatus as defined in claim 12, wherein said drier further includes:

a guide panel opposed to said photosensitive material, said photosensitive material being extended along said guide panel when fed;

plural nozzle holes formed in said guide panel; and an air duct for defining an air path extending from said fan or blower to said guide panel, to direct said air from said fan or blower through said nozzle holes toward said photosensitive material.

14. A photographic processing apparatus as defined in claim 13, wherein said feeding mechanism includes a belt or roller for feeding said photosensitive material opposed to said guide panel.

15. A photographic processing apparatus for photosensitive material, comprising:

a processing bath for processing said photosensitive material;

a drier, positioned downstream from said processing bath, for heating air and for drying said photosensitive material by blowing said photosensitive material with said heated air;

a feeding mechanism for feeding said photosensitive material in a predetermined travel path which begins on an upstream side of said processing bath, extends through said processing bath, and ends at said drier;

a first time estimating unit for estimating expected travel time for passing of said photosensitive material through said predetermined travel path in feeding of said feeding mechanism;

a second time estimating unit for estimating expected warmup time for warming up said air in said drier up to a target temperature;

a controller for comparing said expected travel time and said expected warmup time, for initially starting actuation of said feeding mechanism if said expected warmup time is shorter than said expected travel time, and for starting heating in said drier when elapsed time after start of said actuation of said feeding mechanism becomes equal to a difference between said expected travel time and said expected warmup time, so as to synchronize warmup of said drier to said target temperature with a reach of said photosensitive material to said drier.

* * * * *